US006595093B1

(12) United States Patent
Artigas

(10) Patent No.: US 6,595,093 B1
(45) Date of Patent: Jul. 22, 2003

(54) SHINGLE CUTTING APPARATUS

(76) Inventor: Steven Artigas, 53 Sherwood Dr., Westerly, RI (US) 02891

( * ) Notice: Subject to any disclaimer, the term of this patent is extended or adjusted under 35 U.S.C. 154(b) by 0 days.

(21) Appl. No.: 09/295,887

(22) Filed: Apr. 21, 1999

(51) Int. Cl.[7] ..... B26D 5/10; B26D 7/01

(52) U.S. Cl. ..... 83/468.3; 83/468.7; 83/581; 83/584; 83/605; 83/607; 83/608; 83/920

(58) Field of Search ..... 83/440, 468.3, 83/581, 607, 608, 609, 467.1, 468, 468.1, 468.2, 468.7, 584, 585, 597, 605, 606, 675, 694, 920, 927; 72/388

(56) References Cited

U.S. PATENT DOCUMENTS

| | | | | | |
|---|---|---|---|---|---|
| 28,472 | A | * | 5/1860 | Grover et al. | 83/468.3 |
| 71,668 | A | * | 12/1867 | Walker | 83/581 X |
| RE2,899 | E | * | 3/1868 | McDonald | 83/581 |
| 89,183 | A | * | 4/1869 | Tucker | 83/581 X |
| 145,549 | A | * | 12/1873 | Bancroft | 83/581 X |
| 351,830 | A | * | 11/1886 | Fish | 83/581 X |
| 379,777 | A | * | 3/1888 | Golding | 83/581 X |
| 395,728 | A | * | 1/1889 | Wesel | 83/581 X |
| 413,522 | A | * | 10/1889 | Kelsey et al. | 83/468.3 |
| 524,638 | A | * | 8/1894 | Krah | 83/581 X |
| 679,167 | A | * | 7/1901 | Garding | 83/607 X |
| 713,532 | A | * | 11/1902 | Templeton | 83/607 X |
| 785,978 | A | * | 3/1905 | Ross | 83/733 |
| 834,887 | A | * | 11/1906 | Calhoun | 83/694 X |
| 1,808,054 | A | * | 6/1931 | Meese | 83/468 |
| 2,283,569 | A | * | 5/1942 | Pedersen | 83/468.1 |
| 2,588,999 | A | * | 3/1952 | Tucker | 83/694 X |
| 3,467,154 | A | | 9/1969 | Girard | 83/817 |
| 4,198,888 | A | * | 4/1980 | Gatt | 83/468.1 |
| 4,951,540 | A | | 8/1990 | Cross et al. | 83/397 |
| 4,957,025 | A | | 9/1990 | Beno | 83/607 |
| 4,967,628 | A | | 11/1990 | Judd et al. | 83/455 |
| 5,052,256 | A | | 10/1991 | Morrissey | 83/468 |
| 5,249,495 | A | | 10/1993 | Renk | 83/468.3 |
| 5,392,677 | A | | 2/1995 | Sevart et al. | 83/468.3 |
| 5,758,557 | A | | 6/1998 | Moreton | 83/36 |
| 5,787,781 | A | | 8/1998 | Hile | 83/467.1 |

FOREIGN PATENT DOCUMENTS

| | | | | |
|---|---|---|---|---|
| GB | 697008 | * | 9/1953 | 83/607 |

* cited by examiner

*Primary Examiner*—Clark F. Dexter
(74) *Attorney, Agent, or Firm*—Pandiscio & Pandiscio

(57) ABSTRACT

A portable apparatus for cutting roofing shingles at various angles comprises a rigid frame assembly, a first cutting blade affixed to the frame assembly, a cutting blade assembly comprising a blade-supporting arm pivotally attached to the frame and a second cutting blade affixed to that arm and extending parallel to the first cutting blade, the cutting blade assembly being pivotable so as the second cutting blade can be pivoted into and out of a shingle-shearing relationship with the first cutting blade, and the blade-supporting arm being adjustable laterally of the first cutting blade so as to assure a clean shearing action. A movable guide fence assembly mounted on the frame accurately determines the angle at which a shingle is to be cut.

21 Claims, 8 Drawing Sheets

SHINGLE CUTTING APPARATUS

CROSS-REFERENCE TO RELATED APPLICATIONS

Not applicable.

1. Field of Invention

This invention is an improved and more versatile apparatus for cutting roofing shingles.

2. Description of Prior Art

Installation of roofing shingles requires many cuts to be made in various directions. Traditional practice calls for use of a hand-held utility-type knife which is slow and inaccurate and potentially dangerous since some types of shingles need multiple passes and considerable force with the knife, which can and does slip, causing injury. Several designs have been proposed for an apparatus to cut shingles, however, these designs are limited in performance in various ways. The underlying problem is that shingles resist being cut, and particularly, cut neatly. This is due to their thickness and toughness and the wide range of workability resulting from the extremes of ambient temperature during which they are installed. In cold weather, shingles are stiff and brittle, resistant to cutting, and tend to crack without careful handling. In hot weather, they become exceedingly soft and pliable and prone to tearing. Also, in hot weather, the asphaltic component of the shingles softens into a semi-melted state and accumulates as a tarry deposit on tools. Under any weather conditions, debris and granules from the surface of the shingles are dislodged in handling and collect within the workings of an apparatus not designed to tolerate them.

A shingle cutting apparatus must also take into account that regardless of the design employed a vigorous thrust of the mechanism will be required to effect its operation, again due to the resistance of the shingle being cut. This requirement can be satisfied by proper provision for the use of leverage, however, the apparatus must be configured to remain stable in the face of the forceful stroke by the user. If the apparatus moves or tips in use, it will be inconvenient or dangerous to use.

Prior art fails to overcome these difficulties and therefore has not met with practical success. U.S. Pat. No. 5,052,256 to Morrissey and U.S. Pat. No. 4,951,540 to Cross et al disclose designs that perform only one specialized cut on only one type of shingle. Considered analysis indicates that in addition to this limitation these two designs do not allow the user to develop sufficient leverage to operate successfully under the wide range of field conditions previously mentioned.

A different apparatus is disclosed in U.S. Pat. No. 5,787,781 to Hile. In the initial stages of my own experimentation, I developed, constructed, and tested a model essentially similar to this and determined that it has several shortcomings. The blade does not consistently maintain tight contact with the edge of the work surface because of lack of sufficient rigidity both of the blade and of the pivot arrangement. A very small amount of distortion in the area of the pivot allows the blade to separate from the edge of the work surface and merely sandwich the shingle between the two instead of cutting it. This phenomenon is exacerbated by the accretion of tarry deposits on the mating surfaces of the blade and the edge of the work surface as well as the accumulation of shingle debris and detached surface granules in these deposits and in the pivot area.

Use of a precision bearing as proposed by Hile has a drawback in that it will be vulnerable to damage in the real-world conditions that prevail while roofing is being done. This type of work is frequently carried out under wet conditions; also, the tendency of shingles to generate debris particles and shed granules as previously mentioned will degrade a precision mechanism. Moreover, the need for a complex bearing in this application is questionable, since the motion anticipated is comparatively slow and sporadic and covers something less than a ninety degree arc, whereas a ball or roller bearing would be more appropriately specified in an application having greater or continuous motion and/or higher speed.

Hile shows no method of sharpening the stationary cutting edge. As the edge becomes worn, the tendency of the shingle to be sandwiched between the cutting edge and the blade will increase.

Another shortcoming of Hile derives from the position of the guide member relative to the shingle. Since the shingle resists being cut, the motion of the blade tends to force the shingle to slide away from the pivot, and therefore, away from the guide member at the beginning of the cutting stroke. This reduces the accuracy of the cut. The Hile apparatus also lacks the ability to make an accurate and repeatable angle cut. Further, there is no provision at all to produce the lengthwise cuts that are necessary for the lowest, or starting course of shingles.

Hile proposes the blade to be outside of the footprint outlined by the supporting legs. This may allow the apparatus to tip to the right in response to vigorous force on the handle. In addition, the fact that the handle extends substantially beyond the ends of the legs would tend to cause the opposite, or pivot, end of the apparatus to lift in response to the cutting stroke. Further, the apparent width between the legs of the apparatus would seem to preclude its use on the narrow scaffolding typically used on a roof.

SUMMARY

In accordance with the present invention, a shingle cutting apparatus comprises a raised work surface with a horizontal fixed blade attached along one side, a moveable and adjustable blade assembly, and a guide fence assembly capable of being fixed at any desired location on the work surface to align a shingle for a cut.

OBJECTS AND ADVANTAGES

Accordingly, several objects and advantages of my invention are as follows:

1. The triangular design of the moveable blade assembly, the use of a long pivot shaft attached on both ends, and the design of the frame all provide superior rigidity and keep the moveable and fixed blades in tight contact with each other resulting in clean shearing action. Adjustment is provided to maintain this relationship and to compensate for wear and sharpening.

2. The moveable blade is prevented from distorting by the combination of the blade brace and the triangular web between them that together form a rigid blade assembly.

3. The use of a vertical moveable blade and a horizontal, protruding fixed blade minimizes tarry buildup since the fixed blade acts as a scraper to keep the moveable blade substantially clean. Since this buildup occurs mainly on wide surfaces, the edge of the fixed blade also remains substantially clean.

4. The use of a fixed blade that protrudes beyond the side of the work surface provides clearance for the shingle cutoff, or waste piece, to curl downward during the cut and fall away without dragging on the side of the work surface, which would force the shingle out of position during the cutting stroke.

5. The use of a moveable guide fence permits accurate and repeatable angled or ninety degree cuts. A detent arrangement provides a positive stop for ninety degree cuts.

6. With the guide fence supporting the edge of the shingle furthest from the pivot shaft, the shingle is prevented from sliding in response to the action of the blade. In my apparatus the action of the blade tends to hold the shingle more securely against the guide fence.

7. The guide fence is easily repositioned on the work surface to permit length-wise cutting of shingles. A detent arrangement positively locates the guide fence parallel to the blades and automatically produces proper width cut pieces in accordance with the several standard dimensions used by shingle manufacturers.

8. The design of the pivot shaft minimizes the accumulation of shingle debris land granules that would inhibit proper operation of the moveable blade. The open end of the blade tube extends under the protruding fixed blade to deflect falling debris. More importantly, there is no precision ball or roller bearing mechanism that would be vulnerable to infiltration of debris as well as inflitration of moisture which would create rust. By eliminating a precision bearing, a potential maintainance problem due to rust or contamination is avoided and the apparatus will be simplified.

9. The design of the rear leg enables the user to anchor the device with his or her foot while operating the apparatus if desired. At the same time, the user's foot is protected from injury since it is shielded by the raised frame.

10. The overall shape of the frame assembly is conducive to use on a scaffolding as well as on the roof surface. A leg arrangement providing three points of support results in stability of the apparatus while in use.

11. The handle of the moveable blade does not extend significantly rearward of the footprint outlined by the three points of support of the base assembly. This avoids destabilizing of the apparatus when making a cut. The fact that the blades are laterally within this footprint keeps the apparatus from tipping to the right during operation.

Further objects and advantages of my invention will become apparent from a consideration of the drawings and subsequent description.

DESCRIPTION OF THE DRAWINGS

In the drawings, closely related figures have the same number but different alphabetic suffixes.

FIGS. 3A and 3B are cross sections of the frame assembly.

Figure 1:
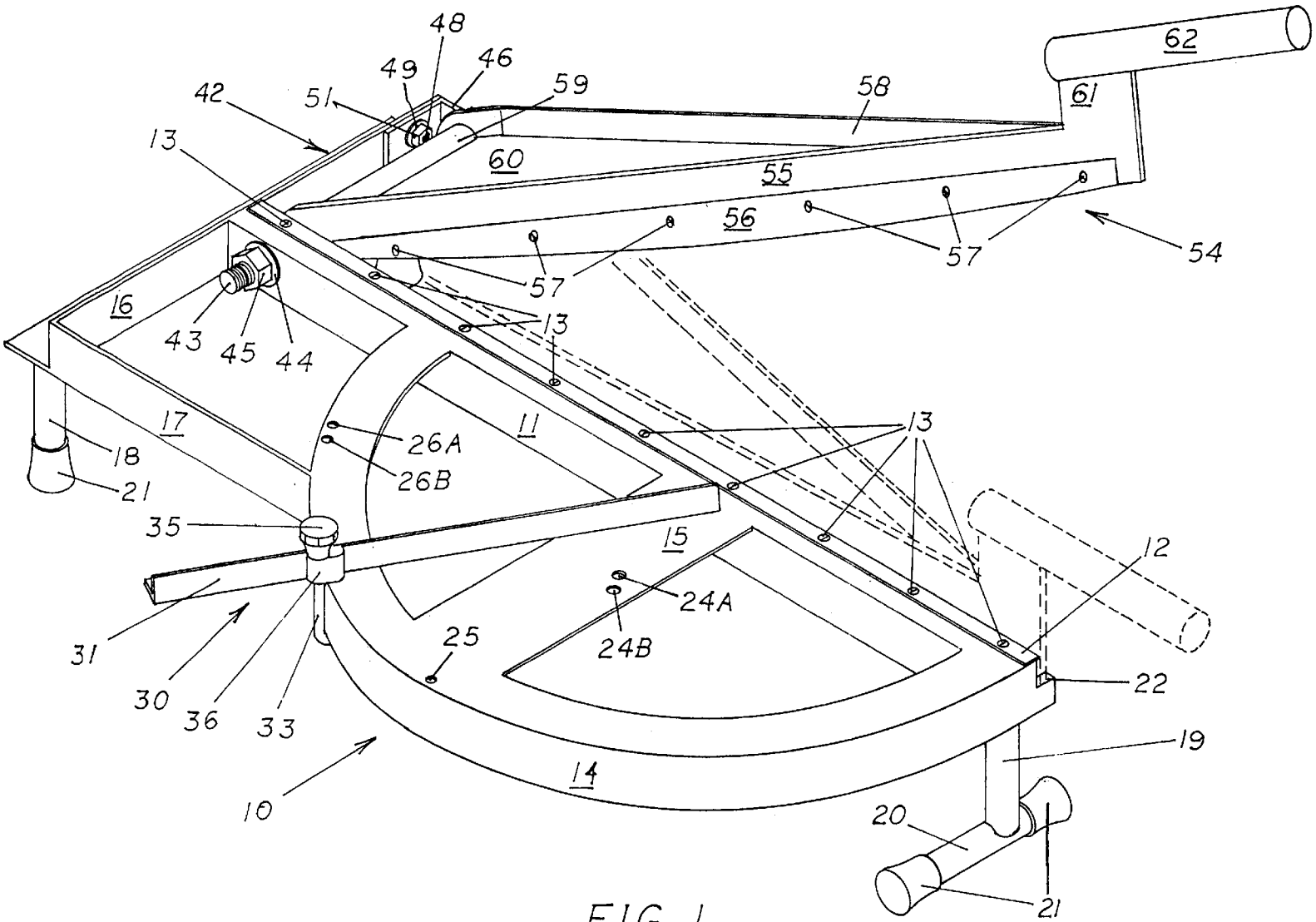
FIG. 1 shows a shingle cutting apparatus with the moveable blade assembly in an open position and the guide fence assembly located for angled cutting.

| REFERENCE NUMERALS IN DRAWINGS | |
|---|---|
| 10. | Frame assembly |
| 11. | Fixed blade support rail |
| 12. | Fixed blade |
| 13. | Screw |
| 14. | Semicircular rail |
| 15. | Guide fence locating plate |
| 16. | Crossbar |
| 17. | Crossbar brace |
| 18. | Front leg |
| 19. | Rear leg |
| 20. | Rear leg extension |
| 21. | Resilient foot |
| 22. | Blade stop |
| 23. | Guide fence anchor pin hole |
| 24A. | Guide fence anchor pin hole |
| 24B. | Guide fence anchor pin hole |
| 25. | Detent hole |
| 26A. | Detent hole |
| 26B. | Detent hole |
| 27. | Shaft bracket bolt hole |
| 28. | Blade shaft hole |
| 30. | Guide fence assembly |
| 31. | Guide fence |
| 32. | Anchor pin |
| 33. | Clamp bolt |
| 34. | Washer |
| 43. | Moveable blade shaft |
| 44. | Shaft washer |
| 45. | Shaft lock nut |
| 46. | Shaft mounting bracket |
| 47. | Mounting bracket hole |
| 48. | Mounting bracket bolt |
| 49. | Flat washer |
| 50. | Shim |
| 51. | Nut |
| 54. | Moveable blade assembly |
| 55. | Blade |
| 56. | Cutting edge |
| 57. | Cutting edge mounting screw |
| 58. | Blade brace |
| 59. | Blade tube |
| 60. | Blade web |
| 61. | Handle support |
| 62. | Handle |
| 63. | Blade tube extension |
| 69. | Adjustment set screw |
| 70. | Spring |
| 71. | Shingle waste piece |
| 72. | Shingle piece desired |
| 73. | Line of cut achieved |

DESCRIPTION OF THE PREFERRED EMBODIMENT

A shingle cutting apparatus as shown in FIGS. 1–10 consists of a frame assembly 10, including reference numerals 11 through 28; a guide fence assembly 30, including reference numerals 31 through 39; a moveable blade shaft assembly 42 including reference numerals 43 through 51; and a moveable blade assembly 54 including reference numerals 55 through 63. The several components are made of metal or other suitable material.

Figure 2:
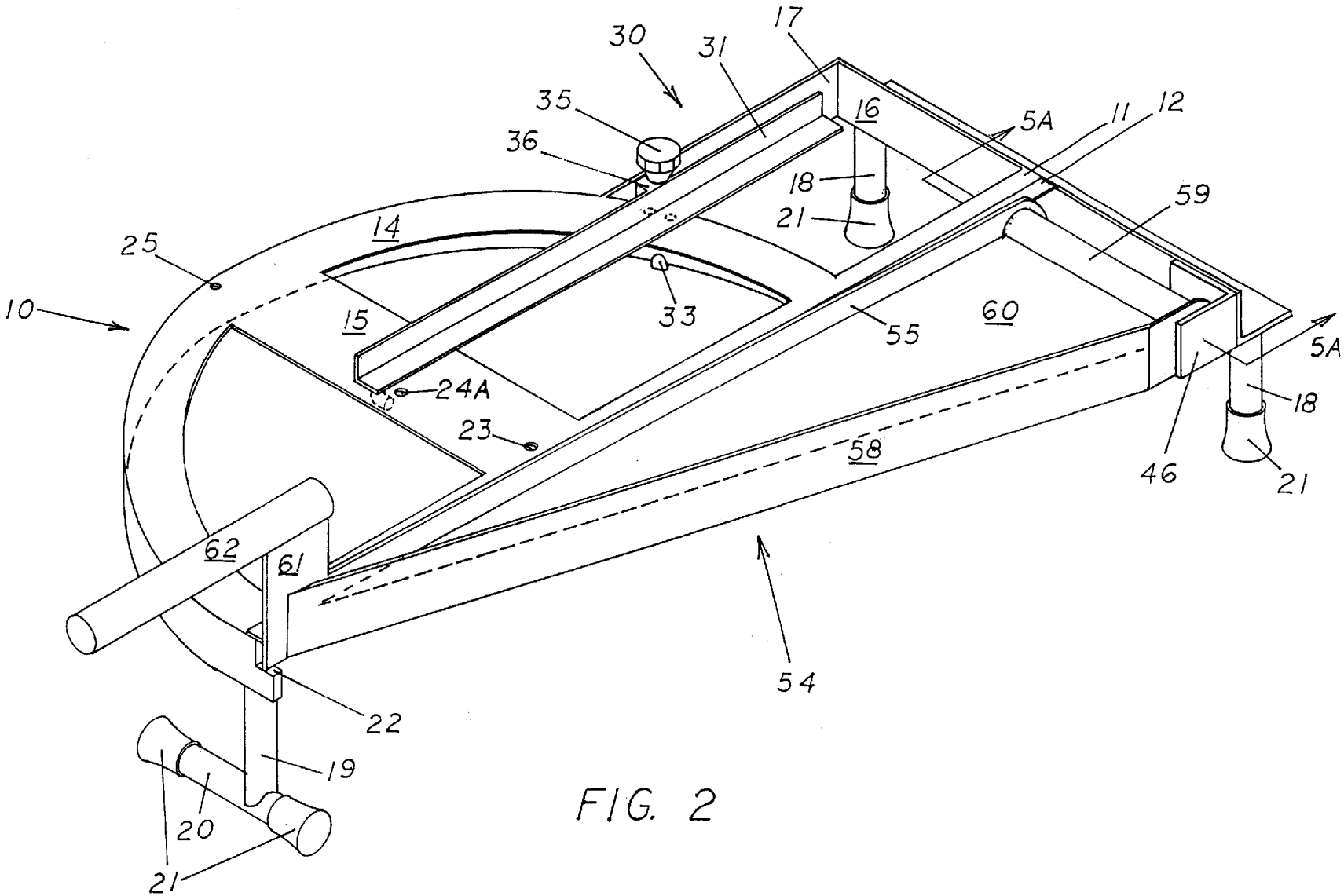
FIG. 2 shows the apparatus with the blade assembly in a closed position and the guide fence assembly located for lengthwise cutting.
Figure 3:
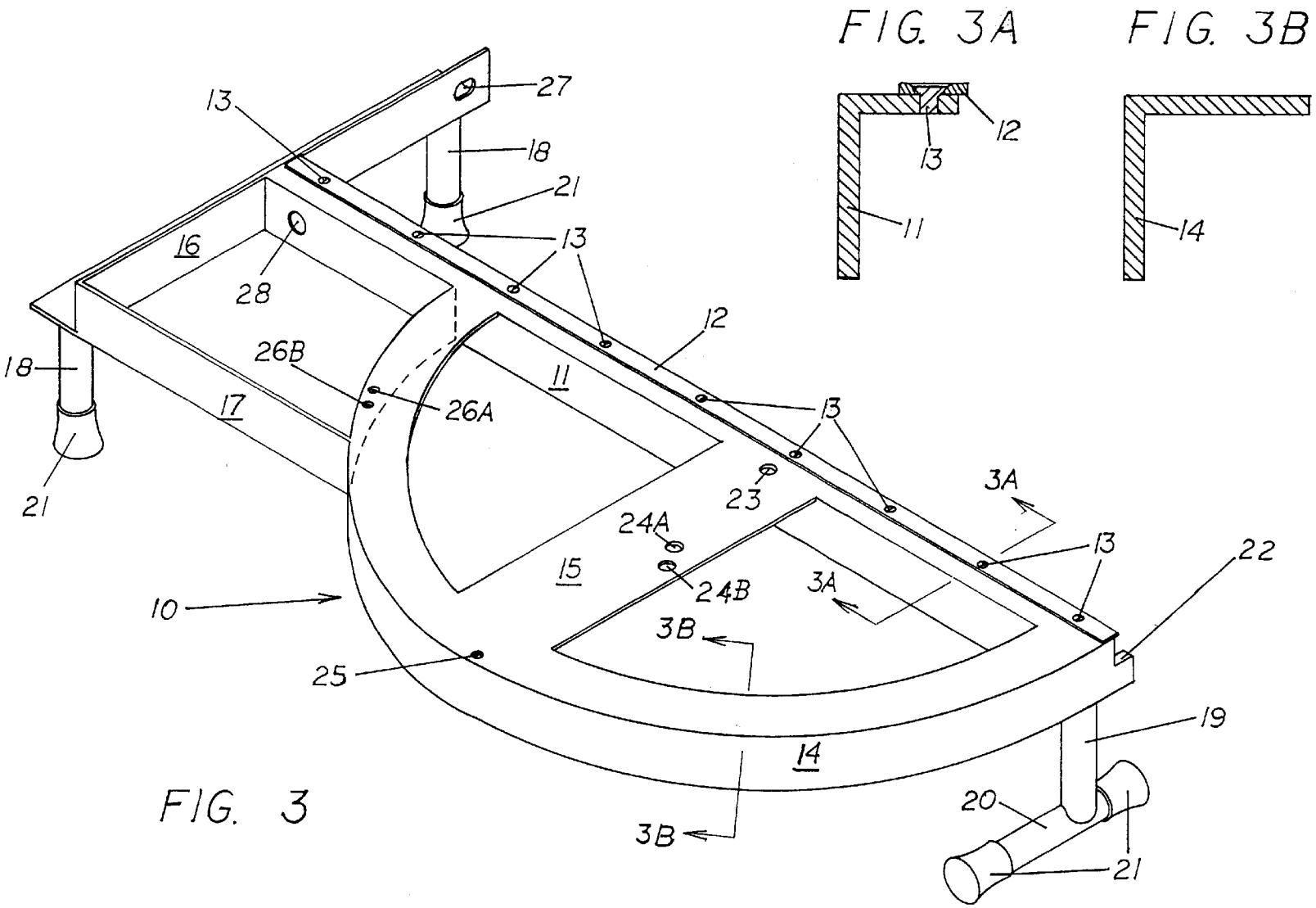
FIG. 3 shows the frame assembly.
Figure 4:
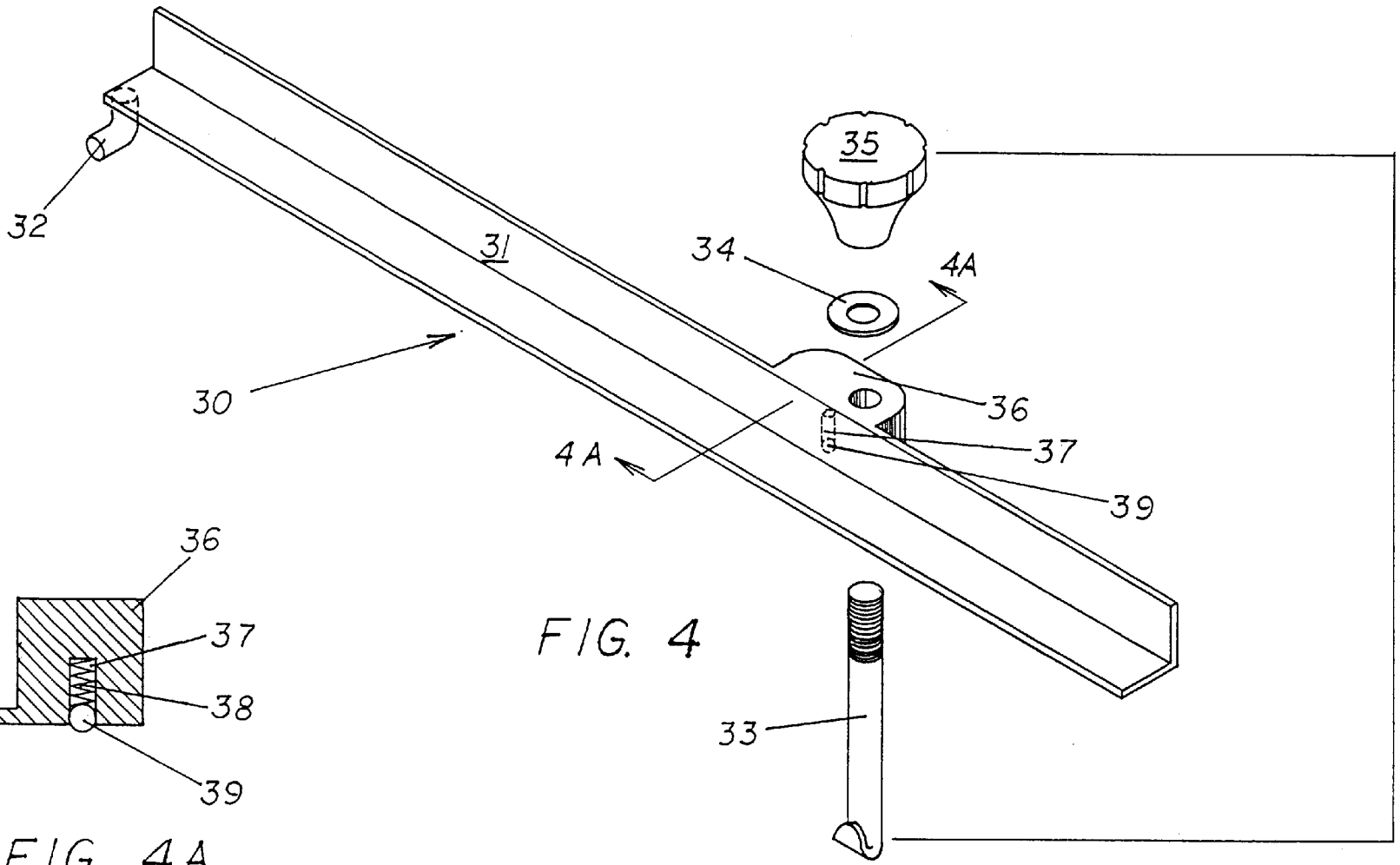
FIG. 4 shows the guide fence assembly.

FRAME ASSEMBLY 10: As shown in FIG. 3, frame assembly 10 has a fixed blade support rail 11, a semicircular rail 14, a guide fence locating plate 15, a crossbar 16, and a crossbar brace 17 that together provide a working surface for the shingle being cut. As shown by FIGS. 1 and 3, support rail 11 carries a fixed blade 12 secured by screws 13. Fixed blade 12 may be made of mild steel, carbide steel, or other suitable material. FIG. 3A shows rail 11 to be of inverted L shape with blade 12 extending laterally to the right, overhanging rail 11. FIG. 3B shows rail 14 also to be in the form of an inverted L having a surface to support guide fence assembly 30 and a lower rim to permit gripping by a clamp bolt 33, seen in FIG. 4. Again referencing FIG. 3, two front legs 18 and a rear leg 19 with a rear leg extension 20 support the apparatus at a convenient height above the surface on which it is used. Resilient feet 21 are provided to afford non-skid positioning of the apparatus and to protect the surface on which it is placed. A blade stop 22 is incorporated into frame assembly 10 to provide a positive limit to the downward cutting stroke. Guide fence anchor pin holes 23, 24A, and 24B are provided in plate 15 for the proper positioning of guide fence assembly 30, shown in FIGS. 1, 2, and 4, in the locations needed for operation. Referring to FIGS. 3 and 4, hole 23 receives an anchor pin 32 on fence assembly 30 when an angled or a ninety degree cut is desired. Sufficient clearance is provided beneath plate 15 in the vicinity of hole 23 to permit unrestricted movement of the angled portion of pin 32 as it describes an arc in response to the repositioning of fence assembly 30 along rail 14. Holes 24A and 24B receive pin 32 when fence assembly 30 is oriented for lengthwise cuts. A detent hole 25 engages a detent ball 39 on fence assembly 30 for alignment at a right angle to blade 12. Detent holes 26A and 26B engage detent ball 39 when fence assembly 30 is oriented for lengthwise cutting. A shaft bracket bolt hole 27 is an elongated hole which receives a bolt 48 to attach a shaft mounting bracket 46, shown in FIG. 5. A blade shaft hole 28 accepts the threaded end of a moveable blade shaft 43, also shown in FIG. 5.

Figure 4A:
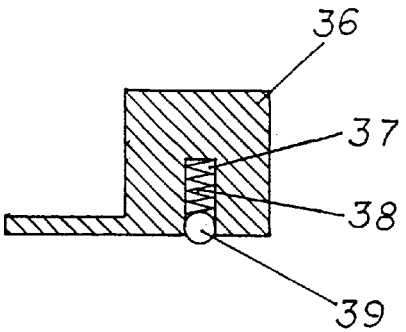
FIG. 4A is a cross section of the guide fence assembly.

GUIDE FENCE ASSEMBLY 30: Guide fence assembly 30, as shown in FIGS. 4 and 4A, has a guide fence 31 with L-shaped anchor pin 32 attached at one end. A clamp bolt 33, a washer 34, and a clamp knob 35 are installed in a clamp bolt housing 36 and designed such that tightening knob 35 causes bolt 33 to grip frame rail 14, and at the same time force the angled portion of anchor pin 32 to contact the underside of plate 15 as shown in FIGS. 1 and 2. FIG. 4A shows a cross section of guide fence assembly 30 taken at the location of detent ball 39 and a detent spring 38 captive in a detent bore 37. Detent ball 39 engages holes 25, 26A, or 26B on frame rail 14 depending on the positioning of guide fence assembly 30.

Figure 5A:
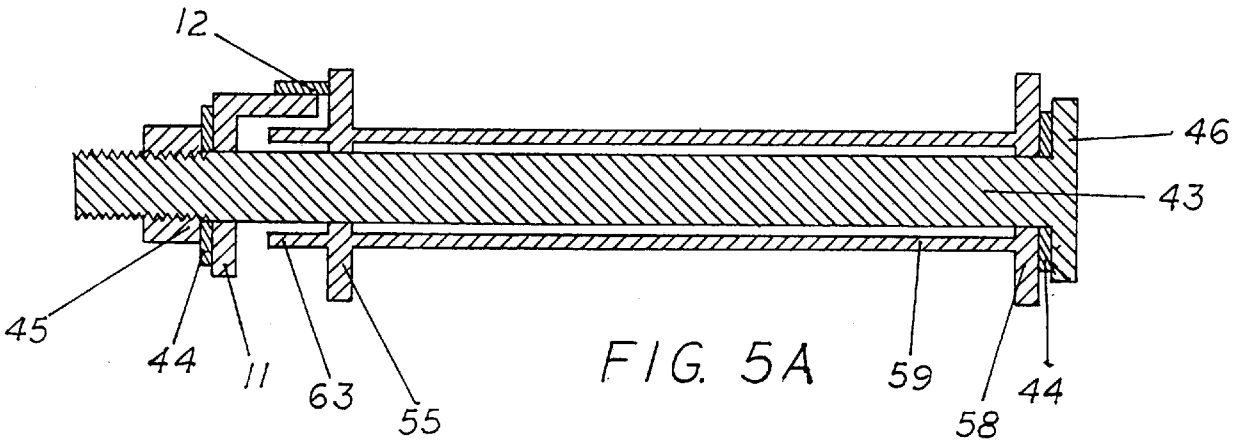
FIG. 5A is a cross section of the moveable blade assembly and moveable blade shaft
Figure 5:
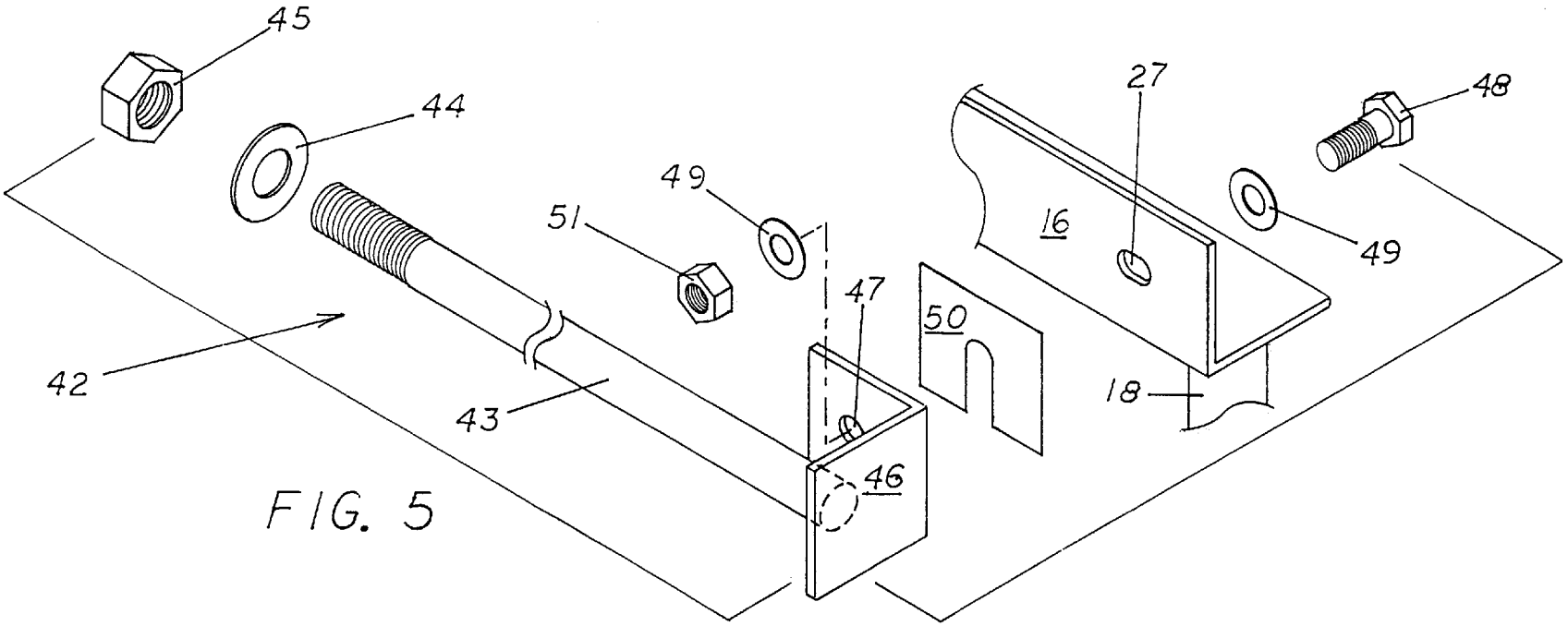
FIG. 5 shows the moveable blade shaft assembly.

MOVEABLE BLADE SHAFT ASSEMBLY 42: FIG. 5 shows moveable blade shaft assembly 42, which attaches to frame assembly 10 by means of holes 27 and 28. After passing through a washer 44 and a blade tube 59 of moveable blade assembly 54, a moveable blade shaft 43 is inserted through hole 28 and secured with another washer 44 and a shaft lock nut 45. FIG. 5A shows a cross section of the assembled positions of these parts. Shaft asembly 42 is further secured through a hole 47 in a shaft mounting bracket 46 by a bolt 48, two washers 49, and a nut 51. One or more shims 50 are provided to adjust the position of blade assembly 54.

Figure 6:
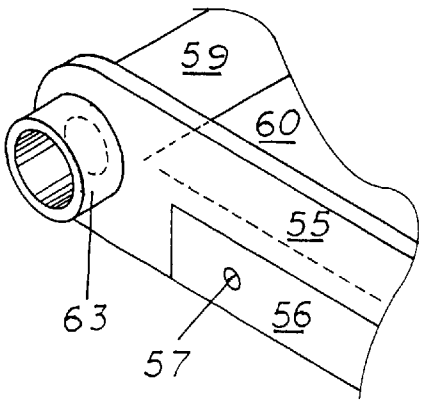
FIG. 6 is a partial view of the moveable blade assembly showing the blade tube extension.

MOVEABLE BLADE ASSEMBLY 54: Moveable blade assembly 54 is shown in FIGS. 1, 2, and 6 and in cross section in FIG. 5A. An elongate support arm 55, supporting a blade 56, is attached to a blade brace 58 and a blade tube 59 and is maintained substantially straight and rigid by a blade web 60. Blade tube 59 is cylindrical in shape and large enough in inside diameter to preclude contact with shaft 43. A blade tube extension 63, seen in FIGS. 5A and 6 reaches under rail 11 and blade 12. The only points of contact between shaft 43 and blade assembly 54 are where the shaft passes through holes in arm 55 and brace 58. A handle support 61 connects a handle 62 to blade assembly 54. Blade 56 is detachably secured to arm 55 with mounting screws 57. Blade 56 may be either curved as shown or straight and may be made of mild steel, carbide steel, or other suitable material.

ASSEMBLY OF THE COMPONENTS: When installed according to the previous description, blade assembly 54 is maintained in firm contact with fixed blade 12 by tightening lock nut 45 while mounting bracket 46 is loosely attached to crossbar 16. Since hole 27 is elongated, blade assembly 54 is free to move laterally in response to the tightening of lock nut 45. One or more shims are then inserted between mounting bracket 46 and crossbar 16, as shown in FIG. 5, to bring the handle end of blade assembly 54 into tight contact with the corresponding end of fixed blade 12. By varying the setting of lock nut 45 and the number of shims 50 used, blade 56 can be made to slide across fixed blade 12 with sufficient tension to remain in contact during use but not so tight as to inhibit the movement of blade assembly 54. Once the proper number of shims has been inserted, bolt 48 and nut 51 are tightened, thereby maintaining the adjustment. This sequence will be repeated when final blade 12 and moveable blade 56 are replaced or sharpened.

Referring to FIGS. 1 and 4, guide fence assembly 30 is installed by tilting it to enable anchor pin 32 to be inserted in hole 23 and then engaging clamp bolt 33 at the desired location on rail 14. Tightening clamp knob 35 secures fence assembly 30 in place. By loosening clamp knob 35, the fence assembly may be pivoted to any desired location on rail 14 without removal. Detent ball 39 engages detent hole 25 to orient fence assembly 30 for right angle cuts. Use of holes 24A and 26A, or alternatively, holes 24B and 26B, allows positioning of fence assembly a 30 for lengthwise cuts as needed. Clamp bolt 33 secures fence assembly 30 in these locations as well, as shown in FIG. 2.

ALTERNATIVE EMBODIMENTS

Figure 7:
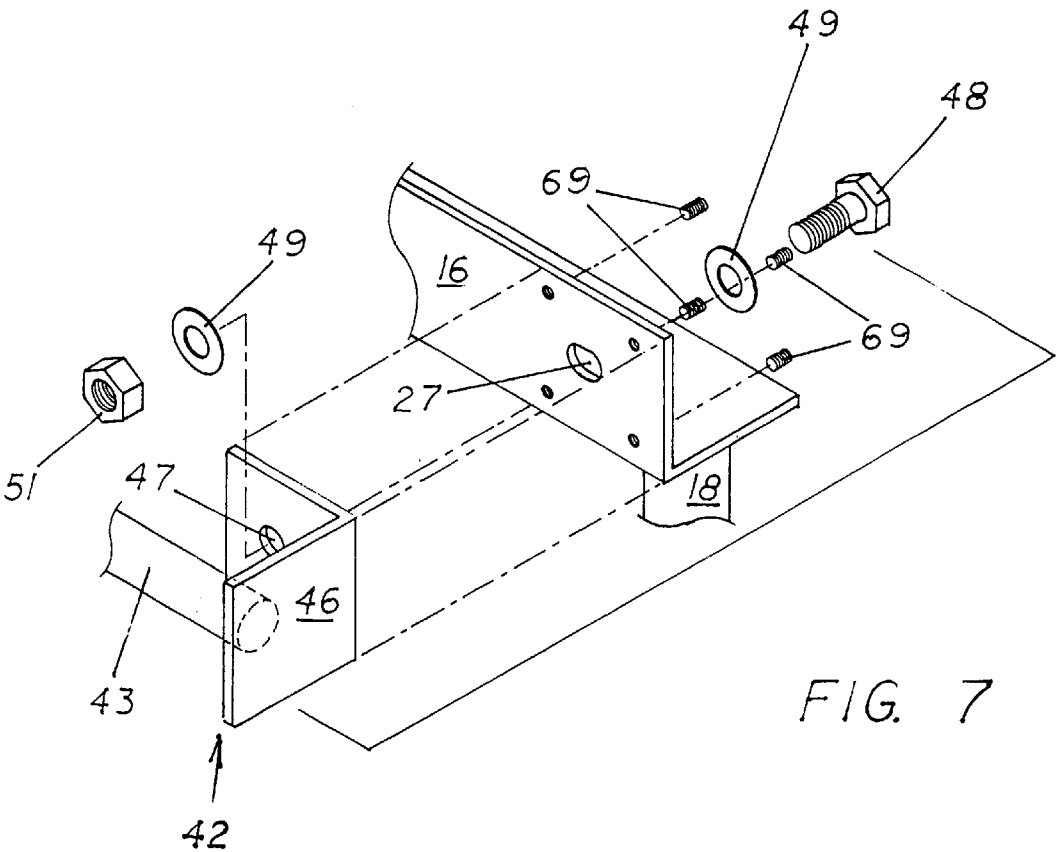
FIG. 7 shows an alternate method of adjusting the blade shaft assembly.
Figure 10:
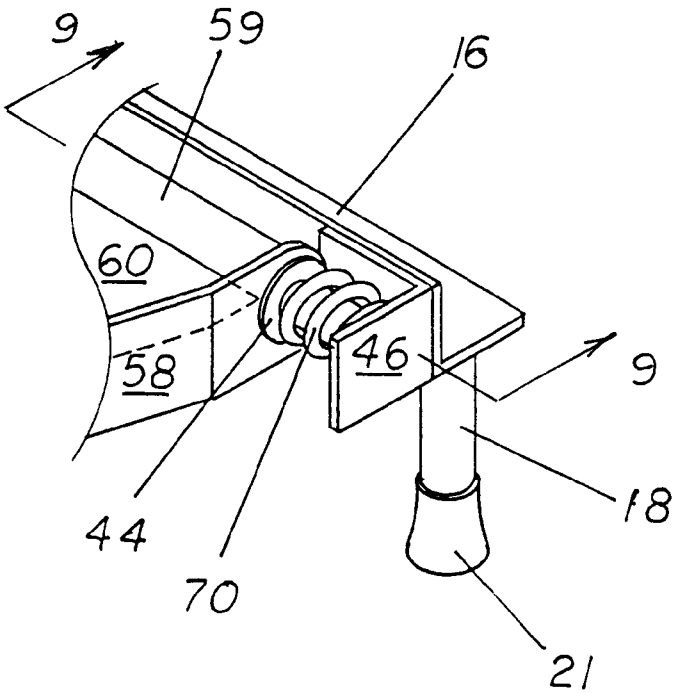
FIG. 10 shows a partial view of the crossbar, the shaft mounting bracket, the washer, and moveable blade assembly in the alternate embodiment with the spring.
Figure 9:
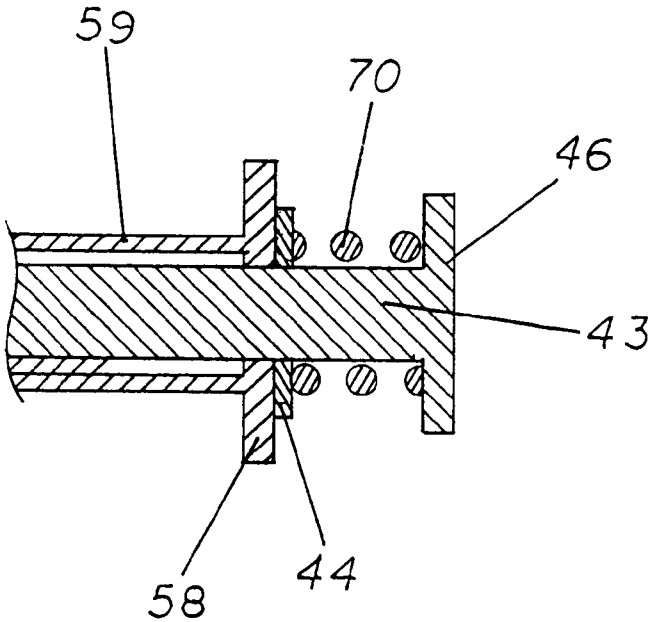
FIG. 9 shows a partial cross section of the moveable blade assembly, the blade shaft assembly, and washer in an alternate embodiment using a spring.

As shown in FIG. 7, an alternate means of adjusting moveable shaft assembly 42 is with the use of threaded set screws 69 in lieu of shims 50. In this embodiment, the assembly and adjustment sequence is analagous to the preferred embodiment except for this substitution. The adjusting of the set screws 69 takes the place of the function of the shims. FIGS. 9 and 10 show another embodiment, utilizing a spring 70 disposed on shaft 43 that takes the place of shims 50 or set screws 69. In the assembly of this embodiment, lock nut 45 is tightened as previously detailed and spring 70 automatically provides the adjustment function that is manually achieved in the other embodiments described.

OPERATION

Figure 8C:
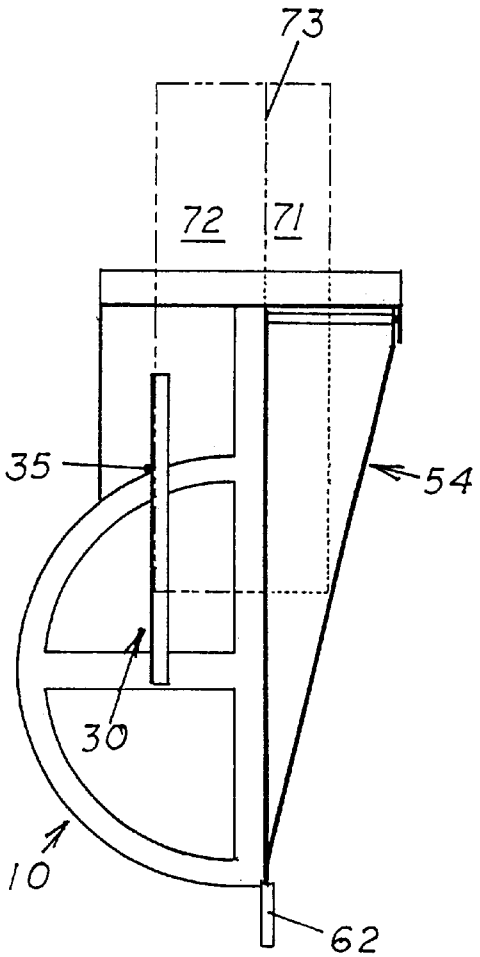
FIGS. 8A, 8B, and 8C are schematics showing the positions of shingles while being cut.
Figure 8B:
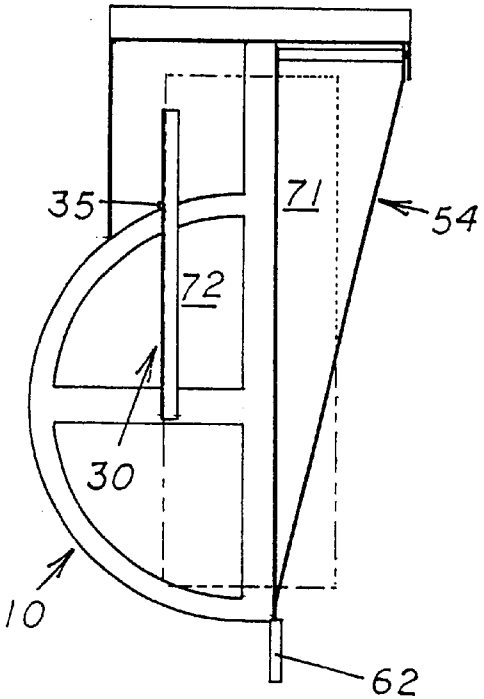
Figure 8A:
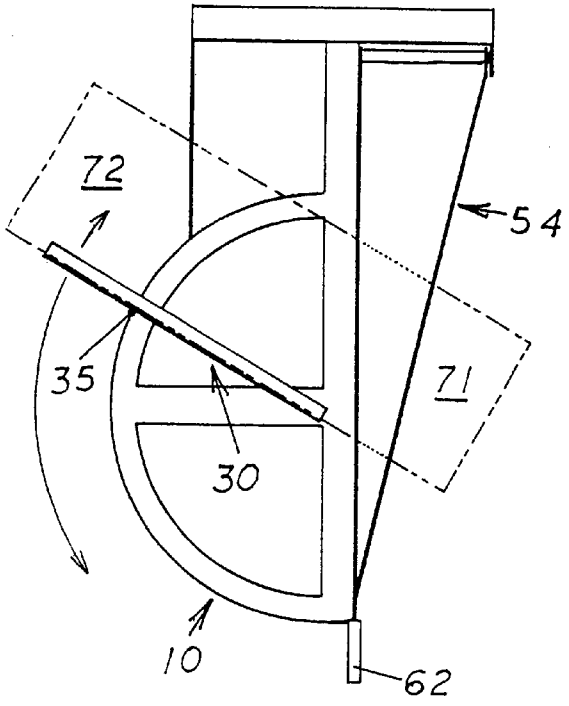

The present invention can be used on the ground, on scaffolding, or on the roof itself. FIGS. 8A–C indicate the juxtapositioning of shingles on the apparatus. Those reference numerals that are not indicated in FIGS. 8A–C are shown in FIGS. 1 through 4. FIG. 8A shows guide fence assembly 30 configured for making an angled crosscut on a shingle. For this type of cut, anchor pin 32 is located in hole 23 on plate 15. With clamp knob 35 loose, fence assembly 30 is pivoted to the desired angle. Knob 35 is then tightened, engaging the lower edge of rail 14 and at the same time causing anchor pin 32 to contact the underside of plate 15, effectively locking fence assembly in position. The user then grasps the handle 62 and raises blade assembly 54. The shingle is inserted against fence assembly 30 and positioned over fixed blade 12 at the appropriate point to produce the desired size cut piece. The user brings blade asembly 54 downward, shearing the shingle, creating a desired cut piece 72 and a waste piece 71. FIGS. 8A–C indicate the outline of the visible portions of the shingles with a dot-dot-dash line and that portion of waste piece 71 that is beneath blade assembly 54 by a dotted line. If a right-angled cut is needed, clamp knob 35 is loosened and fence assembly 30 is rotated along rail 14 until detent ball 39 engages hole 25. Knob 35 is then tightened and cutting proceeds as above.

FIGS. 8B and 8C show the two-step cutting process to produce a lengthwise cut. First, fence assembly 30 is detached by loosening knob 35 until clamp bolt 33 can be completely disengaged from rail 14. Fence assembly 30 is tilted forward to allow anchor pin 32 to be removed from hole 23. Anchor pin 32 is then inserted in hole 24A or 24B in plate 15, depending upon the width of cut piece 72 that is desired. Detent ball is then engaged in hole 26A or 26B respectively and clamp bolt 33 is secured under rail 14 by tightening knob 35. Holes 24A and 26A are used in concert, as are holes 24B and 26B. Due to the length of the shingle, the cut will be made in two passes. Blade assembly 54 is raised, the shingle is inserted along fence assembly 30 as far into the blade as it will go, as represented in FIG. 8B, and the cutting stroke is made. The shingle will be cut somewhat more than halfway along, and the waste piece 71 will fall away to the extent that it has been cut. Blade assembly 54 is then raised. The shingle is then advanced into the blade. Shingle piece desired 72 will slide forward over the front end of frame assembly 10 and waste piece 71 will slide forward under crossbar 16. This position is represented in FIG. 8C. A second stroke of the blade is now made, completing the cut. If desired, the user may brace the apparatus with his or her foot placed on leg extension 20 for additional stability.

The method of adjusting blade tension is described in detail in the section ASSEMBLY OF THE COMPONENTS under the heading DESCRIPTION OF THE PREFERRED EMBODIMENT.

CONCLUSIONS, RAMIFICATIONS, AND SCOPE

By utilizing rigidly designed frame and moveable blade assemblies, cutting action is efficient and not hampered by distortion of the apparatus. The adjustability incorporated into the blade assembly mounting system, previously detailed, allows the crisp cutting action to be maintained in the face of variables such as sharpening and wearing of the blades. The overall size and shape of the apparatus make it convenient to use.

The apparatus is designed to tolerate a hostile working environment. It will not be negatively affected by limited exposure to wet weather on a construction site. The open design of the working surface as well as the protective extension of the blade tube tend to prevent shingle granules and debris from accumulating and hindering operation. The avoidance of any type of precision bearing in favor of a simpler design is further recognition of the adverse effects of moisture and debris infiltration.

The versatility of the guide fence design permits cuts of any orientation to be made quickly and easily. The overall configuration of the apparatus renders it stable in use, and thus safe for the operator. The overhanging fixed blade provides clearance for the shingle waste piece to fall away cleanly, and not drag on the side of the frame to force the shingle out of position during the cut.

While my foregoing description contains many specifics, these should not be construed as limitations on the scope of the invention, but rather as an exemplification of one preferred embodiment thereof. Other variations are possible, for example:

1. Referencing FIGS. 9 and 10, means to maintain tension between moveable blade assembly 54 and fixed blade 12 may comprise a spring 70 on blade shaft 43 in lieu of shims 50 or set screws 69.

2. Fixed blade 12 and cutting edge 56 can be made integral with their respective assemblies, rather than detachable as shown in FIGS. 1 and 3.

3. Blade web 60 may be made of perforated or expanded mesh material to save weight, rather than the solid material shown in FIG. 2.

4. Rear leg extension 20 may be eliminated for simplicity.

5. Threaded set screws 69 may be substituted for shims 50 shown in FIG. 5. This alternate embodiment is shown in FIG. 7.

6. Frame rail 14 may be inscribed with radial markings and numerals indicating angular degrees for reference in positioning guide fence assembly 30. Fence assembly 30 may likewise be inscribed with length markings and numerals to assist in positioning the shingle being cut.

7. Blade tube extension may be eliminated for simplicity.

8. Detent ball 39, spring 38, and bore 37 may be eliminated for simplicity. If this is done, holes 25, 26A and 26B would likewise be eliminated.

9. The semicircular area between rail 14 and rail 11 may be filled in with perforated, mesh, or solid material.

Accordingly, the scope of the invention should be determined not by the embodiment illustrated, but by the appended claims and their legal equivalents.

What is claimed is:

1. A shingle cutting apparatus comprising:

a frame having means for supporting a shingle to be cut, and a first cutting blade affixed to and extending parallel to a frame member;

a cutting blade assembly comprising a hollow tube, an elongate arm, and an elongate brace member secured together in a fixed arrangement, said arm and said brace member each having first and second opposite ends with said first ends thereof being spaced from one another and attached to said tube, said arm extending at a right angle to said tube, said brace member extending at an acute angle to said tube, and said second end of said brace member being attached to said arm adjacent said second end of said arm, and a second cutting blade attached to and extending lengthwise of said arm;

mounting means attached to said frame for pivotally mounting said cutting blade assembly to said frame so that (a) said cutting blade assembly has a pivot axis that is coaxial with said tube, (b) said arm and said second cutting blade extend substantially parallel to said first cutting blade, and (c) said arm is pivotable to move said second cutting blade into and out of a shearing relationship with said first cutting blade, whereby to effect cutting of a shingle that is supported on said frame and interposed between said first and second cutting blades, said mounting means including a shaft that extends through and rotatably supports said tube; and guide means on said frame for positioning a shingle to be cut in any of a number of predetermined angular positions relative to said first and second cutting blades.

2. A shingle cutting apparatus according to claim 1 wherein said guide means is movable.

3. A shingle cutting apparatus according to claim 1 wherein said shaft has first and second opposite ends, and said mounting means further includes a bracket affixed to said first end of said shaft, first means for securing said bracket to a first portion of said frame; and second means for anchoring said second end of said shaft to a second portion of said frame.

4. A shingle cutting apparatus according to claim 3 wherein said frame member constitutes said second portion of said frame, and further wherein said shaft extends through a hole in said frame member and said second means comprises a nut that is screwed onto said second end of said shaft.

5. A shingle cutting apparatus according to claim 3 wherein said first and second means are adjustable to permit adjustment of the position of said shaft in an axial direction.

6. A shingle cutting apparatus according to claim 3 further including means for adjusting the spacing between said bracket and said first portion of said frame so as to vary of the angular position of said shaft relative to said first cutting blade.

7. A shingle cutting apparatus according to claim 3 further including a spring surrounding said shaft and acting between said bracket and said brace member to urge said tube axially toward said first cutting blade.

8. The shingle cutting apparatus of claim 1 wherein said guide means comprises:

a guide fence assembly, movably mounted on said frame for positioning a shingle to be cut relative to said first and second cutting blades; and means for locating said guide fence assembly in any of a plurality of predetermined angular positions relative to said first and second cutting blades, whereby to permit accurate and repeatable cutting of shingles according to which of said predetermined positions is selected.

9. The shingle cutting apparatus of claim 8 wherein said means for locating said guide fence assembly comprises cooperating detent means on said frame and said guide fence assembly, and means for clamping said guide fence assembly in a desired location.

10. The shingle cutting apparatus of claim 8 wherein said guide fence assembly also can be positioned so as to be substantially parallel to said first cutting blade in order to produce a lengthwise cut on a shingle.

11. A shingle cutting apparatus according to claim 1 wherein said frame member is elongate and has a top surface and a side surface that intersects said top surface, with said top surface extending in a plane that is parallel with said tube,and said side surface extending at a right angle to said tube and parallel to said second cutting blade, and said first cutting blade being affixed to said top surface and extending beyond said side surface of said elongate frame member.

12. A shingle cutting apparatus according to claim 1 wherein said tube, said arm and said brace member form a right triangle.

13. A shingle cutting apparatus according to claim 1 wherein frame further includes a second frame member that extends at a right angle to said first-mentioned frame member, with said cutting blade assembly being mounted by said mounting means so that its pivot axis is adjacent and extends parallel to said second frame member, and further wherein said guide means is arranged to engage one side edge of a shingle supported on said frame so as to prevent displacement of said shingle in a direction away from said second frame member when said second cutting blade is pivoted into a shearing relationship with said first cutting blade.

14. A shingle cutting apparatus according to claim 3 wherein said frame includes a semicircular extension attached to and projecting laterally from said first-mentioned frame member, and further wherein said guide means comprises a shingle-positioning guide fence overlying said extension and means including a clamp engaged with the periphery of said circular extension for clamping said guide fence in a selected angular position on said extension.

15. A shingle cutting apparatus comprising:

a frame having a surface for supporting a shingle to be cut, and a first fixed cutting blade attached to and extending along a side of said frame;

a movable blade assembly, said movable blade assembly comprising a hollow tube, a first elongate member disposed at a right angle to said tube, said first elongate member having a first end attached to said tube and a second end that serves as a handle for pivoting said movable blade assembly, a second cutting blade attached to and extending lengthwise of and parallel to said first elongate member, a second elongate member having a first end attached to said tube in spaced relation to said first end of said first elongate member and a second end that is attached to said first elongate member adjacent said second end of said first elongate member, said second elongate member extending at a converging angle to said second end of said first elongate member;

mounting means attached to said frame for pivotally mounting said moveable blade assembly to said frame so that said moveable blade assembly has a pivot axis extending parallel to said tube and so that said second cutting blade extends parallel to said first cutting blade and is movable by pivotal movement of said moveable blade assembly into and out of shearing relation with said first cutting blade; and a shingle guide fence disposed on said surface and movable from one to another of a plurality of angular positions relative to said first and second cutting blades.

16. The shingle cutting apparatus of claim 15 wherein said mounting means comprises a shaft that extends parallel to and through said hollow tube, and means securing said shaft to said frame, and further including a spring that surrounds said shaft and is engaged with said movable blade assembly so as to urge said movable blade assembly in a direction to force said second cutting blade into engagement with said first cutting blade.

17. A shingle cutting apparatus comprising:

a frame having a surface for supporting a shingle to be cut, and a first cutting blade affixed to and extending parallel to an elongate member that forms a part of said frame;

a cutting blade assembly comprising a hollow tube, an elongate arm attached to and extending radially from and at a right angle to said hollow tube, a second cutting blade mounted on and extending lengthwise of said arm, and a brace member attached to and extending outwardly from said tube at an angle to said arm, said brace member also being attached to said arm at a point spaced radially from said tube, and said brace member, said hollow tube and said arm forming a right triangle;

a shaft;

means for mounting said shaft to said frame so that said shaft extends at substantially a right angle to said elongate member, said shaft extending through said tube and said tube being rotatable on its axis relative to said shaft, whereby said cutting blade assembly is rotatably mounted to said frame with said second cutting blade and said arm extending substantially parallel to said first cutting blade and so that said arm can be pivoted to move said second cutting blade into and out of a shearing relationship with said first cutting blade, whereby to effect cutting of a shingle that is supported on said frame and interposed between said first and second cutting blades; and adjustable work guide means on said frame for positioning a shingle to be cut in any of a number of predetermined angular positions relative to said first and second cutting blades.

18. A shingle cutting apparatus according to claim 17 further including a web member extending between said brace member and said arm so as to maintain said arm and said second cutting blade substantially straight and rigid.

19. A shingle cutting apparatus according to claim 17 wherein said shaft has first and second opposite ends, and further wherein said means for mounting said shaft to said frame comprises a bracket affixed to said first end of said shaft, releasable locking means for adjustably locking said bracket to a portion of said frame, and adjustable securing means including a locking nut for securing said second end of said shaft to said elongate member, whereby said cutting blade assembly is movable to adjust the shearing action relationship between said first and second cutting blades.

20. Apparatus according to claim 17 wherein said work guide means comprises:

a guide fence assembly movably mounted on said frame for positioning a shingle to be cut relative to said first and second cutting blades; and means for locating said guide fence assembly in any of a plurality of predetermined angular positions relative to said first and second blades, whereby to permit accurate and repeatable cutting of shingles according to which of said predetermined positions is selected.

21. A shingle cutting apparatus comprising:

a frame having a surface for supporting a shingle to be cut, and a first cutting blade fixed to and extending along a side of said frame;

a movable cutting blade assembly; and attachment means for pivotally attaching said movable cutting blade assembly to said frame;

said movable cutting blade assembly comprising a hollow tube, a cutting blade support arm, a brace member, and a second cutting blade, said cutting blade support arm having first and second opposite ends, said cutting blade support arm extending at a right angle to said tube and having its first end secured to said tube, said brace member having first and second opposite ends, said brace member extending at an acute angle to both said tube and said cutting blade support arm, said brace member having its first end secured to said tube in spaced relation to said first end of said cutting blade support arm and its said second end affixed to said cutting blade support arm so that said first ends of said brace member and said cutting blade support arm are spaced apart a distance greater than the distance between said second ends of said brace member and said cutting blade support arm; and said second cutting blade being attached to and extending lengthwise of and parallel to said cutting blade support arm;

said attachment means comprising a shaft that extends lengthwise within and through said tube, said shaft also extending through holes in said cutting blade support arm and said brace member and being secured at its opposite ends to said frame; and a shingle guide fence overlying said surface and movable from one to another of a plurality of positions relative to said first and second cutting blades.

* * * * *

UNITED STATES PATENT AND TRADEMARK OFFICE

CERTIFICATE OF CORRECTION

PATENT NO. : 6,595,093 B1
DATED : July 22, 2003
INVENTOR(S) : Steven Artigas

It is certified that error appears in the above-identified patent and that said Letters Patent is hereby corrected as shown below:

Column 10,
Line 9, change "3" to -- 13 --.

Signed and Sealed this

Ninth Day of December, 2003

JAMES E. ROGAN
*Director of the United States Patent and Trademark Office*